US008763873B2

(12) United States Patent
Jans

(10) Patent No.: US 8,763,873 B2
(45) Date of Patent: Jul. 1, 2014

(54) APPARATUS AND METHOD FOR SEPARATING A STACK OF SHEETS FROM A PILE OF SHEETS

(75) Inventor: René Jans, KP Eindhoven (NL)

(73) Assignee: J&L Group International, LLC, Keithsville, LA (US)

( * ) Notice: Subject to any disclaimer, the term of this patent is extended or adjusted under 35 U.S.C. 154(b) by 445 days.

(21) Appl. No.: 12/216,001

(22) Filed: Jun. 27, 2008

(65) Prior Publication Data

US 2009/0071994 A1 Mar. 19, 2009

(30) Foreign Application Priority Data

Jun. 29, 2007 (EP) ..... 07012745

(51) Int. Cl.
*B26F 3/00* (2006.01)

(52) U.S. Cl.
USPC ..... 225/96.5

(58) Field of Classification Search
USPC ..... 225/96.5, 103, 105
IPC ..... C03B 33/033,33/03; B26F 3/002
See application file for complete search history.

(56) References Cited

U.S. PATENT DOCUMENTS

| | | | | |
|---|---|---|---|---|
| 1,669,999 | A | 5/1928 | Olsen | |
| 2,171,769 | A | 9/1939 | Stolar et al. | |
| 3,286,893 | A | 11/1966 | Zellers, Jr. | |
| 3,517,869 | A * | 6/1970 | Dryon | 225/2 |
| 3,658,220 | A | 4/1972 | Norton | |
| 4,136,604 | A | 1/1979 | Schmidt | |
| 4,171,081 | A | 10/1979 | Vossen et al. | |
| 4,500,022 | A | 2/1985 | Lucas | |
| 4,714,035 | A | 12/1987 | Engle | |
| 4,987,723 | A | 1/1991 | Diemer | |
| 5,069,195 | A | 12/1991 | Barozzi | |
| 5,297,710 | A * | 3/1994 | Juras | 225/2 |

(Continued)

FOREIGN PATENT DOCUMENTS

| | | |
|---|---|---|
| DE | 2 654 000 | 6/1978 |
| EP | 0 292 067 | 11/1988 |

(Continued)

OTHER PUBLICATIONS

Search Report of European Patent Office in EP 07012745.1—2302, dated Oct. 22, 2007.

(Continued)

*Primary Examiner* — Kenneth E. Peterson
(74) *Attorney, Agent, or Firm* — Dorsey & Whitney LLP; Kenneth E. Levitt, Esq.

(57) ABSTRACT

Apparatus for separating a stack of sheets from a pile of sheet material that is arranged so that tear paths of a plurality of sheets form a tear surface includes a first clamp for clamping the pile at a first side of the tear surface and a second clamp for clamping the pile at a second side of the tear surface. At least the first clamp includes a sustaining member having at least one sustaining point for supporting the pile, and an upper member having at least one contact point for contacting the pile. Rotation of the first clamp relative to the second clamp brings about the separation of a stack of sheets from the pile of sheet material by breaking the tear paths present in the tear surface.

18 Claims, 4 Drawing Sheets

(56) References Cited

U.S. PATENT DOCUMENTS

| | | | | |
|---|---|---|---|---|
| 5,791,038 | A | 8/1998 | Libert et al. | |
| 5,791,539 | A | 8/1998 | Shill et al. | |
| 5,810,156 | A | 9/1998 | Siebels | |
| 5,865,358 | A | 2/1999 | Fernandez | |
| 5,927,582 | A * | 7/1999 | Duecker | 225/2 |
| 6,019,267 | A | 2/2000 | Shill et al. | |
| 6,055,895 | A * | 5/2000 | Kanazawa | 83/24 |
| 6,655,566 | B1 | 12/2003 | Martin et al. | |
| 6,776,748 | B2 | 8/2004 | Joux | |
| 7,370,783 | B2 * | 5/2008 | Hubrecht | 225/101 |
| 2003/0224919 | A1 | 12/2003 | Joux | |
| 2010/0108732 | A1 | 5/2010 | Gendreau | |

FOREIGN PATENT DOCUMENTS

| | | |
|---|---|---|
| EP | 0 509 153 A1 | 10/1992 |
| EP | 1 369 213 A2 | 12/2003 |
| EP | 1 541 304 A1 | 6/2005 |
| FR | 2 704 798 | 11/1994 |
| NL | 1009729 | 1/2000 |
| WO | 2008/129579 | 10/2008 |

OTHER PUBLICATIONS

Communication from EPO regarding European Patent Application No. 07012745.1, Jun. 25, 2010.

Exhibit A—Bundle Breaker III brochure, as early as Jun. 2006.

Exhibit B—Pallmac Omni-Separator brochure and photographs, as early as Dec. 2007.

Exhibit C—Tecasa Fastbreak bundle breaker brochure and photographs, as early as Jun. 2002.

Exhibit D—Visy (replica) bundle breaker photographs, as early as 1995.

Exhibit E—"Report of Dr. Larry Stauffer on the Invalidity of the Asserted Claims in the '566 Patent," Feb. 14, 2008; "Expert Report of Dr. Larry Stauffer Responding to the Expert Reports of Dr. Karvelis and Mr. Talken of Feb. 28, 2008," Mar. 5, 2008.

* cited by examiner

APPARATUS AND METHOD FOR SEPARATING A STACK OF SHEETS FROM A PILE OF SHEETS

TECHNICAL FIELD OF THE INVENTION

The present invention relates to methods and apparatus for separating a stack of sheet material from a pile of sheet materials, which separation is achieved by breaking tear paths or tear lines present in the surfaces of a plurality of stacked sheets.

BACKGROUND OF THE INVENTION

Apparatus for separating or breaking a pile of sheets, such as piles of cardboard or paper sheets, into stacks of sheets are known in the art.

There are at least three main types of apparatus for separating a pile of sheets into stacks of sheets according to a tear surface, which tear surface is constituted by tear paths, usually coplanar tear lines, each sheet in the pile of sheets being provided with at least one tear path along its surface. The tear path may be e.g. a pre-cut line, comprising nicks alternating with notches along the line.

The first type of apparatus comprises at least a first clamp for clamping the pile at a first side of the tear surface and a second clamp for clamping the pile at a second side of the tear surface. Once the clamps are closed, i.e. the pile is brought in a fixed position relative to the clamps, the clamps are moved sidewise, i.e. in a direction substantially perpendicular to the tear surface. This causes the tear lines to break by e.g. causing rupture of the nicks of the pre-cut lines. A first stack of sheets is clamped by the first clamp, and the remainder of the pile of sheets forming the second stack of sheets, is clamped by the second clamp. The maximum height of the stacks that can be broken is dependent on the quality and strength of the sheets to be broken. If sheets with a high breaking strength in a direction parallel to the sheet surface are to be broken, excessive forces are needed to move the clamps sidewise. Often the height of the stack is to be kept small in order to keep the force needed within the machine capabilities. If sheets, even with a low breaking strength in a direction parallel to the sheet surface, but with a low compression resistance in a direction perpendicular to the sheet surface are to be broken, the clamping force applied to the tack is to be kept limited in order to avoid the outer sheets to be damaged by the compression applied by means of the clamps.

Further, in order to prevent slippage of sheets one to the other, and slippage between sheets and surfaces of the clamps contacting the surface, a significantly large clamping force may be required to achieve breaking without sheets displacing one relative to the other. These high clamping forces applied to the pile of sheets can damage the sheets positioned near the upper and lower side of the pile, i.e. near the clamps. As an example, imprints of the clamping surfaces in the surfaces of the outer sheets may occur.

The second and third type of apparatus is apparatus comprising at least a first clamp for clamping the pile at a first side of the tear surface and a second clamp for clamping the pile at a second side of the tear surface. Once the clamps are closed, the clamps are rotated one relative to the other about an axis, which axis is usually substantially parallel to, and usually coplanar with the plurality of tear lines. This causes the tear lines to break, thereby providing a first stack of sheets clamped by the first clamp, and the remainder of the pile of sheets forming the second stack of sheets, clamped by the second clamp. The first of the clamps has an upper element with a contact surface for contacting the upper surface of the stack of sheets. The first of the clamps further has a lower element with a sustaining surface for sustaining the lower surface of the stack.

The second type of apparatus has the axis of rotation positioned beneath the sustaining surface of the first clamp. The clamps rotate one relative to the other about an axis, whereby the distance between the contact surface of the upper element and the second clamp is increased to a larger extent than the increase of the distance between sustaining surface of the lower element and second clamp. This causes the tear lines to break gradually through the height of the pile, starting with the breaking of the tear line closest to the upper element of the first clamp. An example of such apparatus of the second type is shown in U.S. Pat. No. 6,019,267 and EP1541304A1.

For apparatus according to the second type, the sustaining area of the second element of the first clamp is to be dimensioned sufficiently large, enabling holding of stacks of sheets with the largest surface area for which the apparatus is designed. Especially in the longitudinal or machine direction of the apparatus (this is the direction according to which the pile of sheets move through the apparatus), the longitudinal dimension of the second element is to be sufficiently large to be able to hold stacks of sheets with the largest length in longitudinal direction for which the apparatus is designed.

In case the contact surface of the upper element of the first clamp has a smaller length in the longitudinal direction than the lower sustaining element, no unclamped stack of sheets may be present on the sustaining surface during breaking of a stack of sheets. Stacks, which are not clamped during moving of the clamps, may become misaligned by mutually displacing sheets within this unclamped stack. Hence, when stacks of sheets with a relatively short length in longitudinal direction are to be produced, each stack of sheets is to pass along a relatively long longitudinal path to remove the stack from the sustaining surface, before a next stack may be broken off. The time taken up by moving stacks along the long surface area of the second element, causes the yield or stacks per time unit of the apparatus to be low when producing stacks with small length in longitudinal direction.

An alternative is an apparatus with increased length in the longitudinal direction of the contact surface of the upper element, in order to clamp also one or more stacks already broken off. This however causes larger machine elements, e.g. larger clamps, to be moved, hence may cause the energy consumption of the apparatus to increase.

The third type of apparatus has the axis of rotation positioned above the clamps. The first of the clamps has an upper element with a contact surface contacting the upper surface of the stack of sheets. The first of the clamps further has a lower element with a sustaining surface for sustaining the lower surface of the stack. The clamps rotate one relative to the other about an axis, whereby the distance from the sustaining surface of the lower element of the first clamp relative to the second clamp is increased to a larger extent than the distance between contact surface of the upper element and second clamp. This causes the tear lines to break gradually through the pile, starting with the tear line closest to the lower element of the first clamp. An example of such apparatus of the third type is shown in U.S. Pat. No. 6,776,748 B2, more particular in FIG. 1 and FIG. 6 of U.S. Pat. No. 6,776,748 B2. Once the clamping members are brought down to clamp the pile of sheets, the left-hand part of the frame of the apparatus of U.S. Pat. No. 6,776,748 B2 is rotated about the axis in order to break the tear lines present in the sheets of the pile of sheets in transverse direction.

When thin piles are broken using apparatus of the third type, it is noticed that the displacement of the lower clamping elements, which sustain the pile of sheets and the stack of sheets broken off, becomes similar to the movement of the clamps in apparatus according to the first type. The forces applied to the thin piles become similar to the forces used by apparatus according to the first type. Hence the forces applied to thin piles may also tend to damage the surfaces of the sheets.

Further, as the angle of rotation is usually set for higher piles, the displacement of the clamps is usually too large when thin piles are to be divided in to stacks of sheet. Operation time is lost during unnecessary displacement of the clamps one relative to the other. This causes time losses between consecutive breaking operations of the apparatus. Hence the operation time of the apparatus is not optimally used.

SUMMARY OF THE INVENTION

It is an object of the present invention to provide good apparatus and methods for separating stacks of sheets of a pile of sheets. An advantage of the present invention is that it provides apparatus and methods for separating stacks of sheets of a pile of sheets, which are able to operate more efficiently and effectively and substantially independently from the thicknesses of the piles of sheets to be separated.

According to a first aspect of the present invention, an apparatus for separating a stack of sheets from a pile of sheet material is provided. Each sheet has a surface and at least one tear path in the surface. The pile of sheet material is arranged so that tear paths of a plurality of sheets form a tear surface. The apparatus comprises at least

- a first clamp for clamping the pile at a first side of the tear surface and
- a second clamp for clamping the pile at a second side of the tear surface;
- at least the first clamp comprising
  - a sustaining member having at least one sustaining point for supporting the pile, and
  - an upper member having at least one contact point for contacting the pile.
- The first clamp is rotatable relative to the second clamp about an axis. The rotation of the first clamp relative to the second clamp brings about the separation of a stack of sheets from the pile of sheet material by breaking tear paths present in the tear surface The at least one contact point is located between the axis and the sustaining surface and the first clamp is adapted to change between opened and closed conditions. The first clamp in the closed condition holds the pile in a position fixed relative to the sustaining point, the first clamp in the opened condition allowing the pile to move relative to the sustaining point. The distance between axis and sustaining point is adjustable during operation of the apparatus in function of the height of the pile.

The distance between plates moving downwards to press the pile to the support (under which the axis is present) changes during operation. The axis is displaced relative to a sustaining point, hence this point is located under the pile on order to be able to support the pile. Hence the sustaining point is be the lower of the two parts of the elements of the clamp. The term sustaining also makes clear how the first clamp, thus also the axis is positioned relative to the vertical. The clamp is to be understood closed when the pile or stack is fixed in between the contacting point and the sustaining point. It is not necessarily the position where the contacting and sustaining point meet (no product present in the clamp). The clamp is to be understood opened when no pile or stack is fixed in between the contacting point and the sustaining point. It is not necessarily the position for which the distance between the contacting and sustaining point is brought to its maximum.

Optionally, the distance between the axis and the sustaining point may be adjusted during operation of the apparatus, while providing the axis at a height difference of 8 cm to 15 cm above the contacting point, optionally at a height difference in the range of 10 cm to 15 cm, such as in the range of 10 cm to 12 cm. The height difference is measured in a direction perpendicular to the surface of the sheets of the pile.

Some embodiments of apparatus according to the first aspect of the invention have as an advantage that, independent of the height of the pile of sheets, the axis may be provided at the most suitable position above the contacting point for limiting the risk on damage of the sheets, while avoiding time consumption for unnecessary rotation of the clamps. Because the point of rotation, i.e. the position of the axis, is adapted to the height of the pile, the forces used to break the tear paths become substantially independent from the height of the pile. Hence the sheets are broken always in a substantially identical way. By properly adjusting the position of the axis relative to the sustaining point in function of the height, the breaking of the sheets may be done in most favourable conditions independent of the amount of sheets stacked.

As the axis is positioned above the contacting point, the dimensions of the sustaining member must not necessarily be dimensioned sufficiently large for enabling support of stacks of sheets with the largest surface area for which the apparatus is designed. When the stack of sheets is larger than the dimension of the sustention member, more particular when the stack of sheets is longer in longitudinal direction than the sustention member, the whole length of the stack of sheets rotates along. Optionally, some length of the stack of sheets, clamped by the first clamp, is positioned and supported by a sustaining surface of the next apparatus, e.g. a transporting means, such as a transport belt, positioned behind the apparatus according to the first aspect of the present invention. During breaking of the stack, the stack may loose contact with this sustaining surface of the next apparatus. However, as the first clamp clamps the stack of sheets, the sheets of the stack will not displace one relative to the other during rotation of the first and second clamps, one relative to the other. When the stack of sheets, are separated from the remaining pile of sheets, the position of the first stack of sheets on the sustaining surface of the next apparatus will be substantially unaffected.

Hence the dimensions of the sustaining member may be kept limited. The limited dimensions of the sustaining member will allow increasing the yield of stacks per time unit, also In case stacks of sheets with small length in longitudinal direction are provided.

According to some embodiments the second clamp may comprise

- a sustaining member having at least one sustaining point for supporting the pile, and
- an upper member having at least one contact point for contacting the pile.

The second clamp may be similar or identical to the first clamp.

The sheets may be e.g. cardboard sheets such as light or heavy cardboard, single or multiple ply cardboard, corrugated cardboard, boxboard, solid board, or paper sheets having any appropriate constitution, thickness and/or surface weight, such as waxed or plastic coated paper or paperboard, or polymer sheets According to some embodiments, the tear paths may be provided as straight lines or as curved paths in the surface of the sheet. Each path has an average direction. In case the tear paths are tear lines, the tear surface may constitute a tear plane in case all tear lines are coplanar. The tear path may be a pre-cut line or pre-cut path, comprising nicks alternating with notches along the path.

According to some embodiments, the first and second clamps may be mounted in a frame. Some embodiments of apparatus according to the first aspect of the present invention may have a first and second clamps which is mounted moveable within the frame, and moveable one relative to the other. Some embodiments of apparatus according to the first aspect of the present invention may have one of the first and second clamps mounted moveable within the frame, the other of the first and second clamps being in a fixed position relative to the frame.

According to some embodiments, the axis may be substantially perpendicular to the longitudinal direction of the apparatus.

According to some embodiments, the axis may be oriented substantially parallel to the transversal direction of the apparatus According to some embodiments, the sustaining member may have a sustaining surface for supporting the pile. The sustaining surface may be provided by a plurality of sustaining points. The upper member may have a contact surface for contacting the pile, the contact surface being provided by a plurality of contact points.

According to some embodiments, the axis may be substantially parallel to the sustaining surface.

According to some embodiments, the distance between axis and the at least one contact point may remain unchanged during operation of the apparatus.

Optionally the axis may be provided in a fixed position relative to the upper member of the first clamp. The axis may be guided by means of at least one guiding frame. The axis may be provided in such a way that the axis changes position simultaneously with the opening or closing of the first clamp.

According to some embodiments, the distance between axis and the at least one contact point may be settable.

When the apparatus is not operated, one may set, i.e. change the distance between axis and at least one contact point, optionally the contact plane. This setting may be done in function of the type of material form which the sheets are provided, in particular the strength of the sheets.

According to some embodiments, the changing between opened and closed conditions of the first clamp may be independent from the changing between opened and closed conditions of the second clamp.

The apparatus may further comprise additional means such as means to set or adjust the angle over which the first and second clamps rotate for breaking the tear lines. The apparatus may be provided with transporting means for transferring the stack of sheets being separated or broken from the pile to a next station in the production line, of which the apparatus according to the first aspect of the present invention is part. The apparatus may be provided with transporting means for receiving and propagating the pile of sheets in the apparatus, and for positioning the pile of sheets relative to the clamps. The first and optionally also the second clamp may be provided with transport belts being part of the sustaining members. When the clamp or clamps are in opened condition, the transport belts may propagate the pile and/or the stack of sheets to and from the clamps.

According to a second aspect of the present invention, a method of for separating a stack of sheets from a pile of sheet materials is provided. The method comprises:

providing a pile of sheet materials supported at a sustaining point. Each sheet of the sheet materials has a surface and at least one tear path in the surface. The pile of sheet materials is arranged so that tear paths of a plurality of sheets form a tear surface;

clamping the pile of sheet materials at a first side of the tear surface at a first point, clamping the pile of sheets at a second side of the tear surface at a second point and adjusting the distance between the axis and the sustaining point in function of the height of the pile; and breaking the tear surface by rotating the first clamping point relative to the second clamping point thereby bringing about the separation of a stack of sheets from the pile of sheet.

Particular and preferred aspects of the invention are set out in the accompanying independent and dependent claims. Features from the dependent claims may be combined with features of the independent claims and with features of other dependent claims as appropriate and not merely as explicitly set out in the claims.

Although there has been constant improvement, change and evolution of devices in this field, the present concepts are believed to represent substantial new and novel improvements, including departures from prior practices, resulting in the provision of more efficient, stable and reliable devices of this nature.

The above and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

Figure 1:
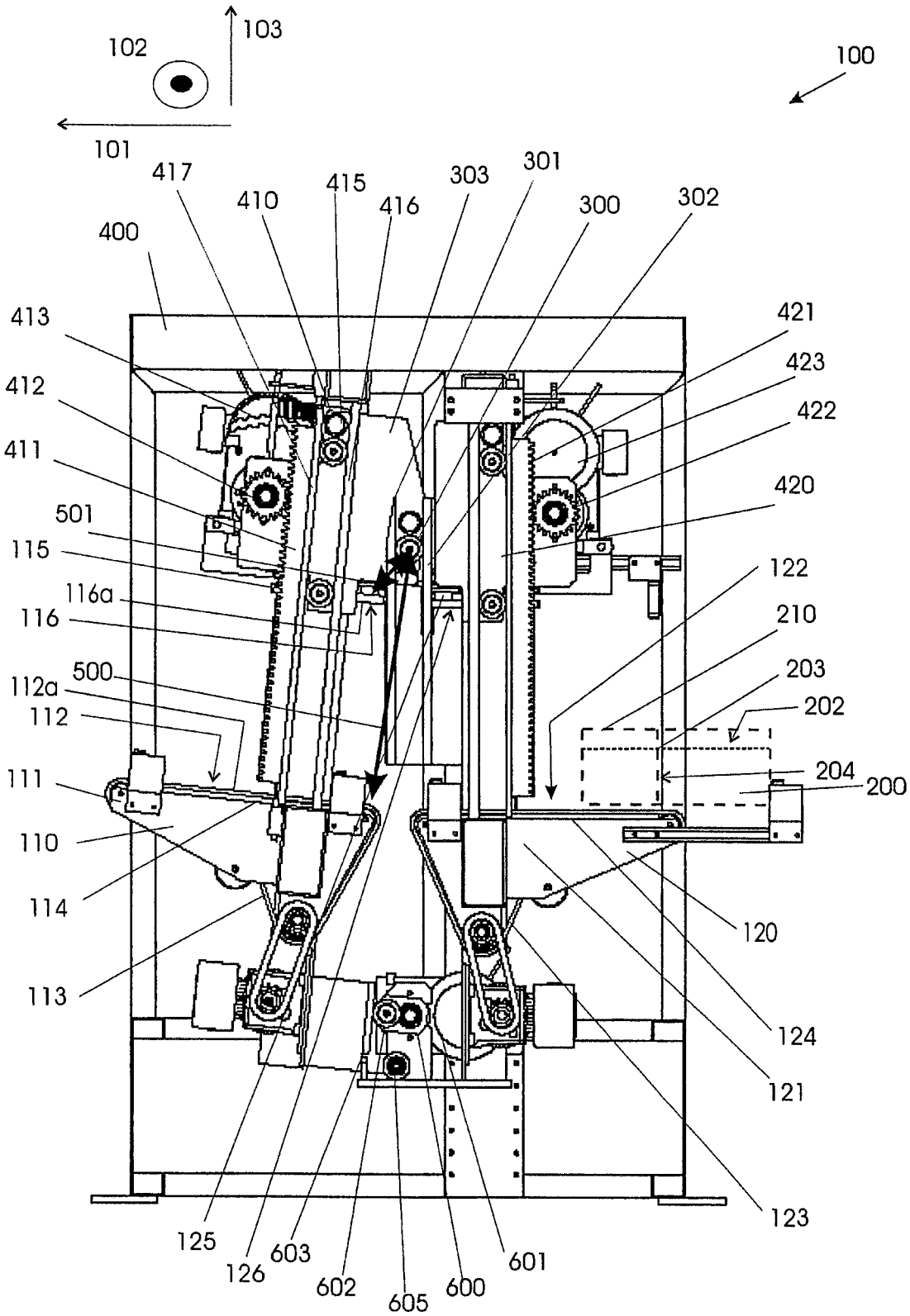
FIG. 1 is a schematically side view of a possible apparatus according to an embodiment of the present invention.

In the different figures, the same reference signs refer to the same or analogous elements.

DESCRIPTION OF ILLUSTRATIVE EMBODIMENTS

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. The dimensions and the relative dimensions do not correspond to actual reductions to practice of the invention.

Furthermore, the terms first, second, third and the like in the description and in the claims, are used for distinguishing between similar elements and not necessarily for describing a sequence, either temporally, spatially, in ranking or in any other manner. It is to be understood that the terms so used are interchangeable under appropriate circumstances and that the embodiments of the invention described herein are capable of operation in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that the embodiments of the invention described herein are capable of operation in other orientations than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Similarly, it is to be noticed that the term "coupled", also used in the claims, should not be interpreted as being restricted to direct connections only. The terms "coupled" and "connected", along with their derivatives, may be used. It should be understood that these terms are not intended as synonyms for each other. Thus, the scope of the expression "a device A coupled to a device B" should not be limited to devices or systems wherein an output of device A is directly connected to an input of device B. It means that there exists a path between an output of A and an input of B which may be a path including other devices or means. "Coupled" may mean that two or more elements are either in direct physical or electrical contact, or that two or more elements are not in direct contact with each other but yet still co-operate or interact with each other.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

Furthermore, some of the embodiments are described herein as a method or combination of elements of a method that can be implemented by a processor of a computer system or by other means of carrying out the function. Thus, a processor with the necessary instructions for carrying out such a method or element of a method forms a means for carrying out the method or element of a method. Furthermore, an element described herein of an apparatus embodiment is an example of a means for carrying out the function performed by the element for the purpose of carrying out the invention.

In the description provided herein, numerous specific details are set forth. However, it is understood that embodiments of the invention may be practiced without these specific details. In other instances, well-known methods, structures and techniques have not been shown in detail in order not to obscure an understanding of this description.

The following terms are provided solely to aid in the understanding of the invention.

The term "longitudinal direction" is to be understood as the direction corresponding to the length of the apparatus (machine direction) and corresponds to the direction in which the pile of sheets moves or propagates through the apparatus. The term "transverse direction" is to be understood as the width of the apparatus and is laterally perpendicular to the longitudinal direction. Usually, the plane defined by the longitudinal and transverse direction corresponds to the horizontal.

The term "height of the pile" is to be understood as the distance between the surfaces of the two sheets of the pile, which surfaces provide a part of the boundary of the pile. The apparatus according to the first aspect of the present invention may be used to break piles of a height up to, but not limited to, 50 cm, such as in the range of 1 cm to 50 cm, e.g. in the range of 6 cm to 45 cm.

The term "distance" between a point and an axis is to be understood as the smallest distance between the axis and the point, measured along a line, which line comprises the point and intersects with and is perpendicular to the axis.

The distance between axis and sustaining surface is to be understood as the minimum distance measurable between a point of the axis and a point of the sustaining surface.

The term "operation" of the apparatus is to be understood as the situation when the apparatus is performing the actions for separating stacks of sheets from a pile of sheets, including the action of opening and closing of the clamps.

The invention will now be described by a detailed description of several embodiments of the invention. It is clear that other embodiments of the invention can be configured according to the knowledge of persons skilled in the art without departing from the true spirit or technical teaching of the invention, the invention being limited only by the terms of the appended claims.

FIG. 1 shows a side view of an apparatus 100, being an embodiment of an apparatus according to a first aspect of the present invention. The apparatus 100 is suitable for separating a stack 210 of sheets from a pile 200 of sheets 201. Each sheet has a surface 202 and at least one tear path 203 in the surface. The pile 200 of sheets 201 is arranged so that tear paths 203 of a plurality of sheets 201 form a tear surface 204. The tear paths are aligned according to the direction of the vertical 103.

The apparatus 100 comprises at least:

- a first clamp 110 for clamping the pile at a first side of the tear surface 204 and
- a second clamp 120 for clamping the pile at a second side of the tear surface 204.

The first clamp 110 comprises

- a sustaining member 111 having at least one sustaining point 112*a* for supporting the pile 200. In this embodiment the sustaining member 111 has a sustaining surface 112.
- an upper member 115 having at least one contact point 116*a* for contacting the pile. In this embodiment the upper member 115 has a contact surface 116.

The second clamp 120 also comprises

- a sustaining member 121 having at least one sustaining point for supporting the pile 200. In this embodiment the sustaining member 121 has a sustaining surface 122.
- an upper member 125 having at least one contact point for contacting the pile 200. In this embodiment the upper member 125 has a contact surface 126.

The first clamp 110 is rotatable relative to the second clamp 120 about an axis 300. The contact surface 116 is located between the axis 300 and the sustaining surface 112. The first, respectively, the second clamp (110, 120) is able to change between opened and closed conditions. In FIG. 1, both clamps 110 and 120 are shown in opened position. In closed condition, the clamps hold the pile in a fixed relative position to the sustaining point or in this particular embodiment, the sustaining surface 112. The pile 200 is carried or supported by the sustaining surface 112 respectively 122. The upper member 115 respectively 125 applies a downwards force to the pile thereby clamping the pile 200 between the sustaining surface 112 respectively 122 and the contact surface 116 respectively 126. This clamping prevents the pile from displacing.

The clamps 110, respectively 120, in opened condition allow the pile 200 to move relative to the sustaining surfaces 112, respectively, 122. This moving can be effected by means of any suitable moving or displacing means. In the embodiment of FIG. 1, the sustaining surfaces comprise a transport belt 113 respectively 123, upon which the pile 200 or stack after separation is carried. The transport belt itself is supported by a supporting means such as a supporting plate 114 respectively 124. In closed condition, the supporting plate supports the transport belt and the pile, whereas in opened condition, the transport belt may e.g. slideably, move relative to the supporting plate.

The first and second clamps 110 respectively 120 are mounted in a frame 400.

The second clamp 120 is mounted on a fixed bar 420, i.e. a bar remaining at least in a fixed position during operation. The bar 420 in this particular embodiment is oriented according to the vertical direction. The sustaining member 121 of the second clamp 120 is coupled to the bar 420 in a fixed relation. The upper member 125 is moveable along the bar 420, i.e. moveable in substantially vertical direction 103. This moving may be done by any appropriate means, e.g. by means of guiding rails, guiding the upper element along the bar 420, which upper member is displaced using appropriate jacks or pistons, such as hydraulically or pneumatically activated pistons. As an example shown in the embodiment shown in FIG. 1, the upper member 125 is moved up and down along the bar 420 by means of a gear, comprising a rack 421 which is fixed to the bar 420. The rack cooperates with a gear wheel 422. The gear wheel is driven by means of a motor 423. By rotating the gear wheel 422, the upper element 125 of the second clamp 120 is moved upwards or downwards for bringing the clamp 120 in opened or closed position. The upper member 125 further may comprise additional means to guide the upper member 125 along, and maintain the orientation of the upper member 125 relative to the bar 420.

Though only one side of the apparatus 100 is shown, the skilled person understands that identical means such as gear wheels and racks are provided at the other side of the apparatus, in order to provide a rigid and operational construction. It is understood that optionally one motor 423 may be used to rotate synchronously the gear wheels at both sides of the apparatus.

The first clamp 110 is mounted on a bar 410. The sustaining member 111 of the first clamp 110 is coupled to the bar 410 in a fixed relation. The upper member 115 is moveable along the bar 410, i.e. in the longitudinal direction of the bar 410. Similarly, as set out with regard to the second clamp, the moving of the upper member 115 relative to the bar 410 may be effected using any appropriate displacing system. Optionally as shown in FIG. 1, the upper member 115 is moved up and down by means of a gear, comprising a rack 411 which is fixed to the bar 410. The rack cooperates with a gear wheel 412. The gear wheel is driven by means of a motor 413. By rotating the gear wheel 412, the upper element 115 of the first clamp 110 is moved along the bar 410 for changing or switching the first clamp 110 between opened and closed position.

The upper member 115 further may comprise additional means, such as a guiding wheel 415, mounted between two guide bars 416 and 417, for guiding the upper member 115 along, and maintaining the orientation of the upper member 115 relative to the bar 410.

Similarly to that set out above with regard to the second clamp, though only one side of the apparatus 100 is shown in FIG. 1, the skilled person understands that identical means such as gear wheels, racks, guiding wheels and guiding bars are provided at the other side of the apparatus, in order to provide a rigid and operational construction. It is understood that optionally one motor 413 may be used to synchronously rotate the gear wheels at both sides of the apparatus.

The axis 300 is substantially parallel to the sustaining surface 112 of the first clamp 110.

The first clamp 110 is rotatable relative to the second clamp 120 about an axis 300. The distance 500 between axis 300 and the sustaining surface 112 of the first clamp 110 is adjustable during operation of the apparatus in function of the height of the pile of which a stack of sheets is to be separated. This may be obtained by means of a configuration as shown in FIG. 1. The skilled person however understands that also other configurations may provide a first clamp being rotatable relative to the second clamp while the distance 500 between axis and the sustaining surface of the first clamp is adjustable during operation of the apparatus in function of the height of the pile.

The outer end of the axis 300 is guided between two guiding bars 301 and 302. The guide bars 301 and 302 define a path which the outer end of axis 300 is to follow when the axis is moved up and down between the guide bars 301 and 302. In the embodiment shown in FIG. 1, the guiding bars 301 and 302 define a path for the axis 300 which is substantially parallel to the orientation of the longitudinal direction of the bar 420, i.e. substantially parallel to the vertical direction 103. The axis 300 may be set in a fixed position relative to the upper element 115 by any appropriate means, such as by means of a fixing plate 303 as shown in FIG. 1. The axis 300 is simultaneously moveable with the displacement of the upper member 115 of the first clamp 110 during changing from opened to closed position. During changing from opened to closed position, i.e. during operation of the apparatus, the distance 500 between axis 300 and sustaining surface 112 is changed. As the distance between contact surface and sustaining surface is a function of the height of the pile to be clamped, the distance 500 between axis 300 and sustaining surface 112 is changed in function of the height of the pile to be clamped as well. The axis 300, set in a fixed position relative to the contact surface 116 of the upper element 115, the axis 300 maintains its height difference 501 with the contact surface 116 during operation.

The bar 410 on which the first clamp 110 is mounted, is coupled to the frame 400, more particular to the bar 420 by means of an eccentric cam 600. A motor 601 drives the eccentric cam 600. An eccentric cam wheel 602, eccentrically positioned relative to the centre of rotation of the eccentric cam 600, forces the bar 410 to move away from the bar 420 by forcing the contact plate or follower plate 603 to move sidewise, or as shown in FIG. 1, forcing the follower plate 603 to the left. The coupling mechanism of bar 410 to the frame 400 further comprises a supporting wheel 605, transferring the weight of the bar 410, and all parts being carried by the bar 410, to the frame 400. When the eccentric cam 600 has brought the bar 410 to its outmost position, the gravity force will bring the bar 410 back to its original position, while the follower plate 603 can move back.

When the first clamp 110 is now in a closed condition, i.e. a pile of sheet material is clamped between the contact surface 116 and the sustaining surface 112, the upper member 115 is prevented from moving along the direction of bar 410. If not, the pile 200 would not be clamped. Bringing the gear wheel 412 in a condition in which it is prevented from rotating, e.g. by blocking the motor 413, may prevent the upper member 410 from moving.

As the upper member is prevented from moving along the bar 410, the axis is prevented from moving along the path between the guiding bars 416 and 417.

As the eccentric cam 600 forces the bar 410 to move sidewise, the bar 410 can only rotate about axis 300. Similarly, after the eccentric cam 600 has forced the bar 410 to its outmost position, the bar 410 will return to its original position by rotation about axis 300.

It is understood that the first and second clamps are provided adjacent one another, abutting along a boundary optionally in transverse direction 102. The apparatus 100 is suitable for separating stacks from the pile of sheets along tear paths which are substantially in the transverse direction, i.e. whose average direction is substantially parallel with the transverse direction of the apparatus (transverse to the machine direction). The sustaining surfaces 112 and 122 are optionally provided in a coplanar manner. The sustaining surfaces 112 and 122 may be oriented to the horizontal, i.e. the plane provided by the longitudinal 101 and transverse 102 directions of the apparatus 100. The pile and the stacks of sheets are to propagate through the machine according to the longitudinal direction 101. As shown in FIG. 1, the axis 300 is oriented substantially aligned with the transverse direction 102 of the apparatus 100.

It is understood that, as an alternative, the first and second clamps may abut along a boundary in longitudinal direction 101. The apparatus having first and second clamps abutting along a boundary in longitudinal direction 101 is suitable for separating stacks along tear paths which are substantially in the longitudinal direction, i.e. whose average direction is substantially parallel with the longitudinal direction of the apparatus (i.e. machine direction). The skilled parson understands that the frame is to be constructed in such a way that the frame allows passing of the pile and stacks of sheets along the longitudinal direction.

In FIG. 1 the first clamp 110 is mounted moveablely relative to the second clamp 120, which itself is in a fixed position relative the frame 400. It is understood that other configurations may be applied, wherein the first clamp is in a fixed position relative to the frame, and the second clamp is rotatable moveablely about the axis relative to the first clamp. It is understood that configurations may be applied, wherein the first clamp and the second clamp are rotatable moveablely about the axis relative to each other, and wherein both clamps are moveably coupled to the frame.

The apparatus as shown in FIG. 1 may e.g. have a length according to the longitudinal direction of about 1 m to about 2 m, wherein each of the sustaining surfaces has a length in longitudinal direction of about 0.5 m to about 1 m. As an example an apparatus with a length according to the longitudinal direction of 2 m, wherein each of the sustaining surfaces has a length in longitudinal direction 1 m is provided.

The width of the machine, i.e. the distance between the bars in transverse direction, which corresponds to the width of the sustaining surfaces, may e.g. range from 1.2 m to 3 m, such as between 1.4 m to 2.9 m, e.g. from 1.6 m to 2.8 m.

The maximum distance between contact surface and sustaining surface of each of the clamps is e.g. 0.7 m or less, such as 0.6 m or less. Although the contact surface and sustaining surface might be brought one in contact with the other, a minimum distance, such as 0.06 m may be provided. Although the maximum height of piles, which can be separated into stacks, may vary according to the properties of the sheet material, the maximum height of pile that can be separated is, preferably about 50 cm, e.g. 45 cm. The maximum angle over which the first and second clamps may rotate is, preferably about 10°. The distance between contact surface 116 and axis 300 is usually kept between 8 cm and 15 cm, optionally between 10 cm and 15 cm, such as between 10 cm and 12 cm, but may be set in function of the properties of the sheets to be separated.

Figure 2A:
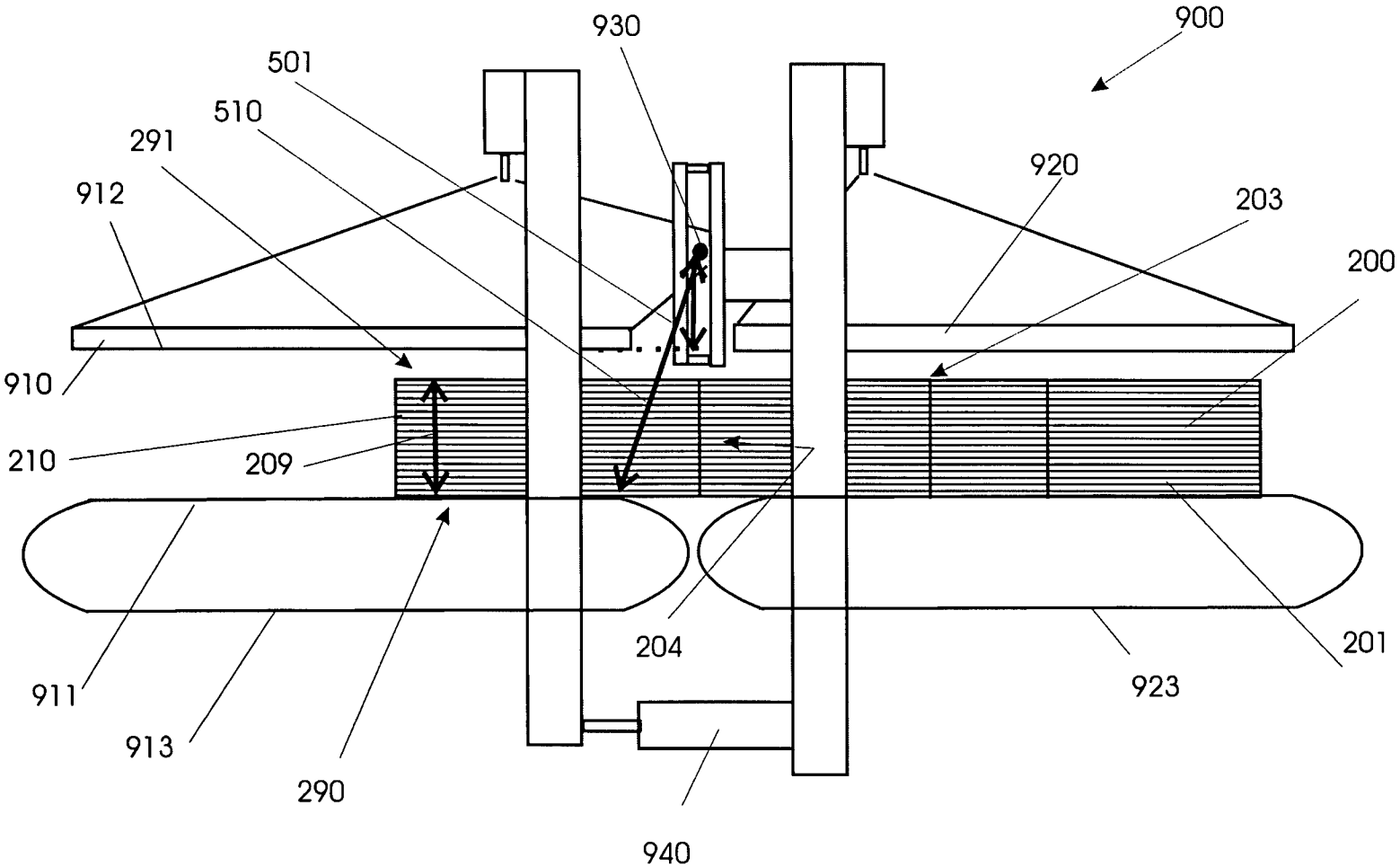
FIG. 2*a*, FIG. 2*b* and FIG. 2*c* are schematic views of consecutive steps of a method according to a second embodiment of the present invention.
Figure 2B:
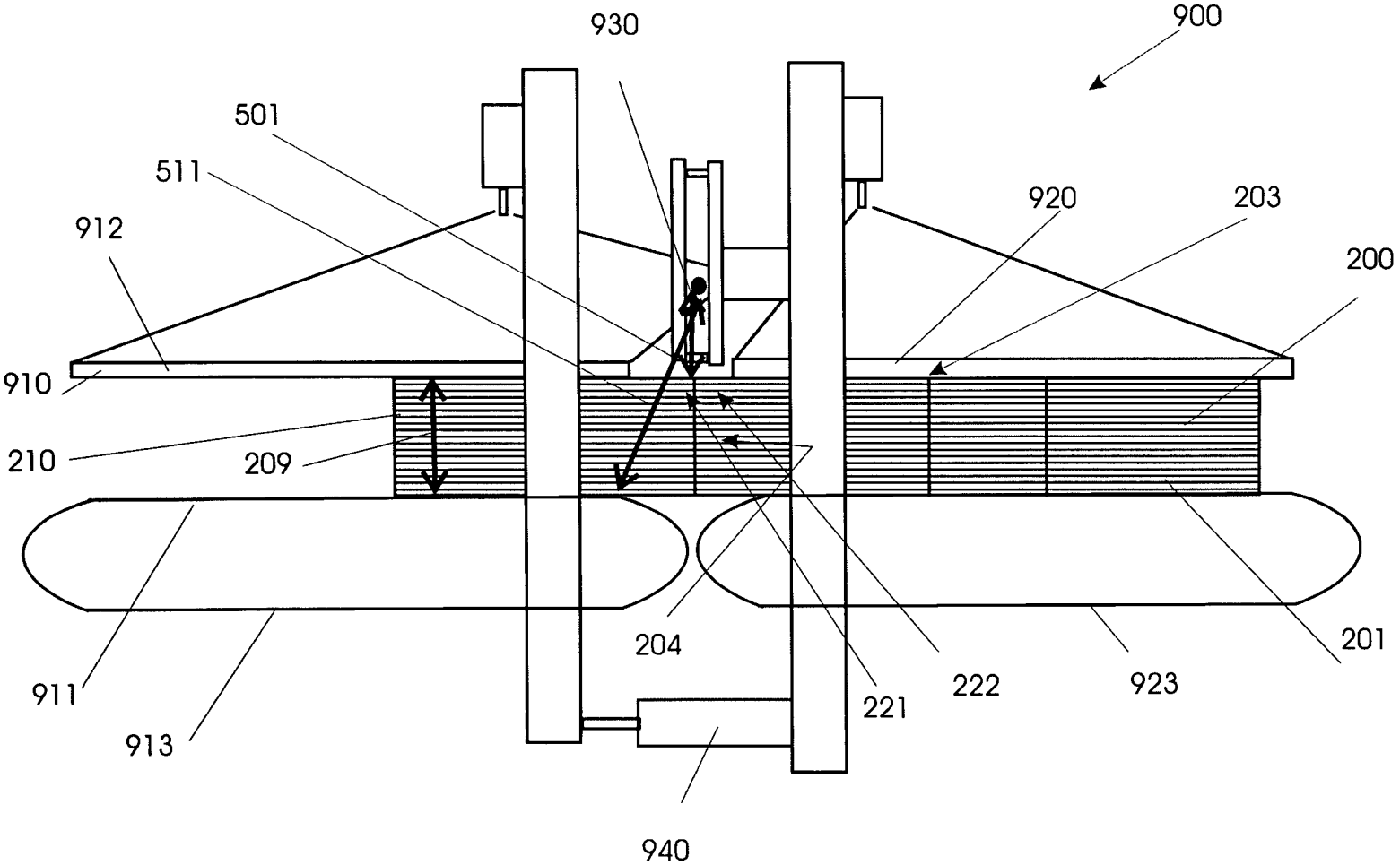
Figure 2C:
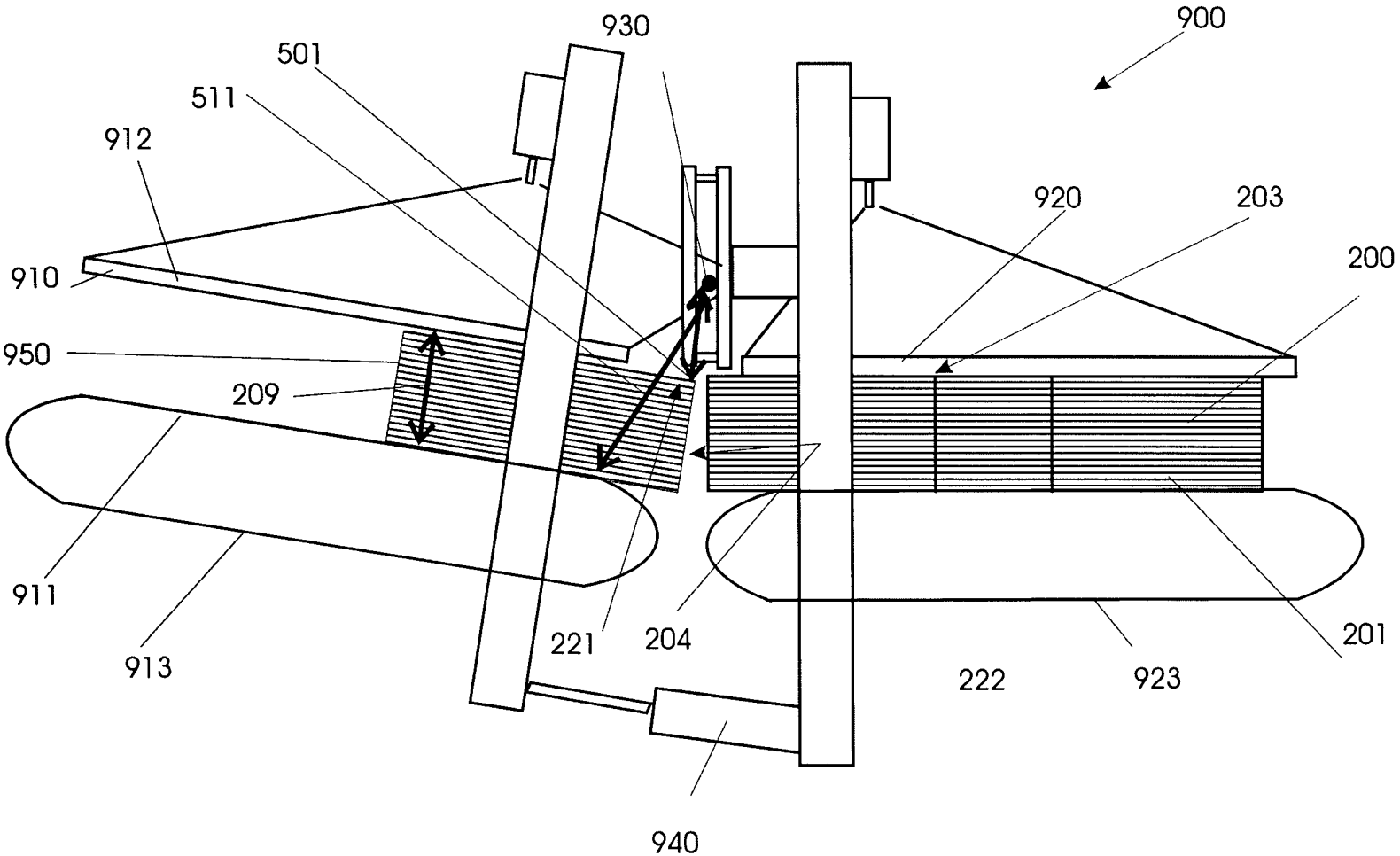

Turning to a second aspect of the present invention, FIG. 2*a* to FIG. 2*c* show schematically steps of a method according to an embodiment of the present invention for separating a stack of sheets from a pile of sheets.

An apparatus 900 for separating a stack of sheets 210 from a pile 200 of sheets 201 is provided, comprising at least:

- a first clamp 910 for clamping a pile of sheets pile, the first clamp comprising
  - a sustaining member 911 having at least one sustaining point for supporting the pile_along at least a part of the lower surface 290 of the pile, and
  - an upper member 912 having at least one contact point for contacting the pile along at least a part of the upper surface 291 of the pile,
- a second clamp 920 for clamping a pile of sheets 200;
- The first clamp 910 is rotatable relative to the second clamp 920 about an axis 930.

A pile 200 of sheets 201 is provided, each sheet 201 having a surface 202 and at least one tear path 203 in the surface. In the embodiment shown, the tear path is a tear line, however this is not to be understood as limiting. Tear paths may also be substantially linear, or curved. The pile of sheets is arranged so that tear paths of a plurality of sheets form a tear surface 204. The tear surface may be provided as a tear plane, in case all tear paths are tear lines oriented in a coplanar manner.

The pile 200 is provided between the clamps in opened position, shown in FIG. 2*a*.

The clamps are now changed from opened to closed position resulting in the situation as shown in FIG. 2*b*.

The first clamp 910 clamps the pile of sheets 200 at a first side 221 of the tear surface 204. The second clamp 920 clamps the pile of sheets 200 at a second side 222 of the tear surface 204. The distance between axis and sustaining surface of the first clamp, which is indicated 510 in FIG. 2*a*, is adjusted to a distance 511 in function of the height 209 of the pile. The adjustment may be done simultaneously while closing the first clamp, or may be done after the first clamp is changed to closed position, by means of a separate adjusting means.

Rotating the first clamp 910 relative to the second clamp 920 about the axis 930 breaks the tear surface. In FIG. 2*c*, this rotation is effected by activation of the piston 940. It is understood that other systems for providing rotation of the clamps, such as the use of eccentrics as shown in FIG. 1 may be used.

A separate stack 950 of sheets is provided, which is sustained by the sustaining surface of the sustaining member 911 of the first clamp 910. At least the first clamp is changed to an opened position by moving the contacting surface and the axis upwards, i.e. away from the sustaining surface. This allows the separated stack 950 of sheets to be removed and provided to e.g. a next device in the production line of which the apparatus is part of. The contacting surface and the axis is moved from the sustaining surface over a distance usually ranging from 3 cm to 15 cm. This distance may vary in function of the flatness of the upper surface of the stack. In case the upper surface 291 of the stack is substantially flat, a distance of 3 cm may be used. The less flat the upper surface is, the larger the distance will have to be in order to avoid contact of the upper surface with the contacting surface during displacement of the stack. Usually the maximum applicable distance is about 15 cm.

The stack 950 of sheets may now be moved further by e.g. moving of a transport belt 913 present at the sustaining surface. The pile 200 of sheets is further brought into the apparatus by e.g. rotation of a transport belt 923, after the second clamp is changed to opened position. This movement of the pile and the stack may be synchronized.

Other arrangements for accomplishing the objectives of the apparatus and method embodying the invention will be obvious for those skilled in the art.

It is to be understood that although preferred embodiments, specific constructions and configurations, as well as materials, have been discussed herein for apparatus according to the present invention, various changes or modifications in form and detail may be made without departing from the scope of this invention as defined by the appended claims.

The invention claimed is:

1. An apparatus for separating a stack of sheets from a pile of sheet material, each sheet having at least one tear path, the pile of sheet material being arranged so that the tear paths of a plurality of sheets form a tear surface, the apparatus comprising:

a first clamp for clamping the pile at a first side of the tear surface, the first clamp comprising a sustaining member and an upper member and being adapted to change between an opened and closed condition, wherein the sustaining member has a sustaining member surface for supporting the sheet material;

a second clamp for clamping the pile at a second side of the tear surface;

a stationary frame supporting the first and second clamps; and an axis about which the sustaining member of the first clamp is rotatable relative to the second clamp, the rotation bringing about the separation of a stack of sheets from the pile of sheet material along the tear surface, the axis being moveable relative to the stationary frame and the sustaining member along one or more guide bars defining a path that is generally perpendicular to the sustaining member surface, such that the distance between the axis and the sustaining member is adjustable, wherein movement of the axis along the guide bars occurs during the operation of clamping the pile so as to adjust a position of the upper member as a function of a height of the pile of sheet material.

2. An apparatus according to claim 1, wherein the axis is substantially perpendicular to the longitudinal direction of the apparatus.

3. An apparatus according to claim 1, wherein the axis is oriented substantially parallel to the transversal direction of the apparatus.

4. An apparatus according to claim 1, wherein the path defined by the one or more guide bars is substantially vertical.

5. An apparatus according to claim 1, wherein the sustaining member has a sustaining surface for supporting the pile, the sustaining surface being provided by a plurality of sustaining points, and wherein the upper member has a contact surface for contacting the pile, the contact surface being provided by a plurality of contact points.

6. An apparatus according to claim 1, wherein the distance between the axis and the upper member remains fixed during operation of the apparatus.

7. An apparatus according to claim 6, wherein the distance between the axis and the upper member is settable.

8. An apparatus according to claim 1, wherein the opened condition of the first clamp allows the pile to move relative the sustaining member and the closed condition of the first clamp holds the pile in a position generally fixed between the sustaining member and the upper member.

9. An apparatus according to claim 8, wherein the changing between opened and closed conditions of the first clamp is independent from the changing between opened and closed conditions of the second clamp.

10. An apparatus according to claim 8, wherein the distance between the axis and the sustaining member is adjustable simultaneously with changing the first clamp to the closed position.

11. An apparatus according to claim 1, wherein movement of the axis along the guide bars does not occur during the operation of rotating the first clamp relative to the second clamp such that the axis remains in a fixed position relative to the stationary frame as the stack of sheets is separated from the pile of sheet material.

12. An apparatus according to claim 1, wherein the axis is maintained in a fixed position relative to the upper member such that a distance between the axis and the upper member remains constant during the operation of clamping the pile and during the operation of rotating the first clamp relative to the second clamp.

13. An apparatus according to claim 1, wherein the second clamp comprises a sustaining member and an upper member and is adapted to change between an opened and closed condition, wherein the sustaining member of the second clamp has a sustaining member surface for supporting the sheet material and is maintained in a fixed position relative to the stationary frame.

14. An apparatus for separating a stack of sheets from a pile of sheet material, the pile of sheet material being arranged so that tear paths of a plurality of sheets form a tear surface, the apparatus comprising:

a first clamp having a first clamping member and a second clamping member for clamping the pile at a first side of the tear surface, the first clamping member having a first clamping member surface for supporting the sheet material and being provided on a first side relative to the pile and the second clamping member provided on a second side relative to the pile opposite the first side;

a second clamp for clamping the pile at a second side of the tear surface;

a stationary frame supporting the first and second clamps; and an axis about which the first clamp is rotatable relative to the second clamp, the axis being moveable relative to the stationary frame along one or more guide bars in a direction that is generally perpendicular to the first clamping member surface such that the distance between the axis and the first clamping member surface is adjustable, wherein movement of the axis along the guide bars occurs during the operation of clamping the pile so as to adjust a position of the second clamping member as a function of a height of the pile of sheet material.

15. An apparatus according to claim 14, wherein the axis is moved relative the first clamping member surface simultaneously with the clamping of the pile on at least one of the first or second sides of the tear surface.

16. An apparatus according to claim 14, wherein rotation of the first clamp relative to the second clamp brings about the separation of the stack of sheets from the pile of sheet material along the tear surface, and movement of the axis along the guide bars does not occur during the operation of rotating the first clamp relative to the second clamp such that the axis remains in a fixed position relative to the stationary frame as the stack of sheets is separated from the pile of sheet material.

17. An apparatus according to claim 14, wherein the axis is maintained in a fixed position relative to the second clamping member such that a distance between the axis and the second clamping member remains constant during the operation of clamping the pile and during the operation of rotating the first clamp relative to the second clamp.

18. An apparatus according to claim 14, wherein the second clamp comprises a third clamping member and a fourth clamping member for clamping the pile at a first side of the tear surface, wherein the third clamping member has a third clamping member surface for supporting the sheet material and is provided on a first side relative to the pile, wherein the third clamping surface is maintained in a fixed position relative to the stationary frame.

* * * * *